US006037873A

United States Patent [19]

Preston

[11] Patent Number: 6,037,873

[45] Date of Patent: Mar. 14, 2000

[54] BATHING BASIN MONITORING SYSTEM

[76] Inventor: Grant E. Preston, 50 Kyle Crescent, Keswick, Ontario, Canada, L4P 3P6

[21] Appl. No.: 09/199,247

[22] Filed: Nov. 25, 1998

[51] Int. Cl.[7] ..... G08B 21/00

[52] U.S. Cl. ..... 340/618; 340/584; 340/622; 340/693.5; 340/693.9; 73/290 R; 73/291; 73/292; 73/293

[58] Field of Search ..... 4/538, 546, 559, 4/661, 668; 340/618, 620, 584, 612, 622, 623, 693.9, 624, 693.5; 73/290 R, 291, 292

[56] References Cited

U.S. PATENT DOCUMENTS

| | | | |
|---|---|---|---|
| 4,757,305 | 7/1988 | Peso | 340/624 |
| 4,771,272 | 9/1988 | Barnes | 73/DIG. 5 |
| 5,371,491 | 12/1994 | Wu | 340/632 |
| 5,621,390 | 4/1997 | Neal | 340/584 |
| 5,894,611 | 4/1999 | Toro | 4/559 |

*Primary Examiner*—Julie Lieu

[57] ABSTRACT

A bathing basin monitoring system is provided including a housing with a couple adapted for securing to a bathing basin. A speaker is mounted on the housing for emitting audio signals. Also included is a moisture/temperature sensor assembly having a moisture sensor positioned at a desired water line for generating an activation signal upon the detection of water and a temperature sensor for generating a temperature signal indicative of a temperature. At least one display is mounted on the housing for depicting numeric characters. A controller is positioned within the housing and connected to the speaker and sensors of the moisture/temperature sensor assembly. The controller serves to display a current temperature detected by the temperature sensor on the display and emit an alarm from the speaker upon the receipt of the activation signal.

9 Claims, 2 Drawing Sheets

BATHING BASIN MONITORING SYSTEM

BACKGROUND OF THE INVENTION

1. Field of the Invention

The present invention relates to water monitoring devices and more particularly pertains to a new bathing basin monitoring system for indicating a temperature and the presence of a maximum water level within a bathing basin along with additional functions.

2. Description of the Prior Art

The use of water monitoring devices is known in the prior art. More specifically, water monitoring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5.621,390; U.S. Pat. No. 4,922,226; U.S. Pat. No. 5,371,491; U.S. Pat. No. 5,230,563; U.S. Pat. No. 3,241,368; and U.S. Pat. Des. No. 313,567.

In these respects, the bathing basin monitoring system according to the present invention substantially departs from the conventional concepts and designs of the prior art, and in so doing provides an apparatus primarily developed for the purpose of indicating a temperature and the presence of a maximum water level within a bathing basin along with additional functions.

SUMMARY OF THE INVENTION

In view of the foregoing disadvantages inherent in the known types of water monitoring devices now present in the prior art, the present invention provides a new bathing basin monitoring system construction wherein the same can be utilized for indicating a temperature and the presence of a maximum water level within a bathing basin along with additional functions.

The general purpose of the present invention, which will be described subsequently in greater detail, is to provide a new bathing basin monitoring system apparatus and method which has many of the advantages of the water monitoring devices mentioned heretofore and many novel features that result in a new bathing basin monitoring system which is not anticipated, rendered obvious, suggested, or even implied by any of the prior art water monitoring devices, either alone or in any combination thereof.

To attain this, the present invention generally comprises a housing having a lower portion with a circular horizontal cross-section and an elliptical vertical cross-section. The housing further has an upper portion centrally mounted on a top face of the lower portion. Such upper portion has a circular horizontal cross-section with a tapering diameter from bottom to top. As shown in the Figures, the housing further includes a pair of rigid planar rectangular strips each having a top end mounted on a bottom face of the lower portion of the housing. These strips extend downwardly from the housing in parallel relationship to define a slot. This slot is adapted for releasably receiving an upper peripheral edge of a bathing basin wall. A pair of vertically spaced suction cups are mounted on inner surfaces of the strips which are adapted to engage the bathing basin wall. As best shown in FIGS. 3 & 4, a tightening threaded rod is threadedly engaged within a pair of threaded apertures formed in the strips above the suction cups. A cylindrical handle has a central extent mounted to the threaded rod for selectively rotation the same. By this structure, the strips may be securely clamped about the bathing basin wall. It should be noted that the housing has a front face on a side opposite the handle of the tightening rod and a rear face opposite the front face. Mounted on the front face of the housing is a speaker which is positioned at a periphery of the lower portion thereof for emitting audio signals. Also included is a moisture/temperature sensor assembly including a threaded rod threadedly engaged within a vertically oriented threaded bore formed in the lower portion of the housing at the front face thereof. Similar to the clamping threaded rod, the present threaded rod is equipped with a cylindrical handle having a central extent mounted to a top end of the threaded rod of the moisture/temperature sensor assembly. A moisture sensor is positioned on a bottom end of the threaded rod of the moisture/temperature sensor assembly for generating an activation signal upon the detection of water. Associated therewith is a temperature sensor mounted on the bottom end of the threaded rod of the moisture/temperature sensor assembly for generating a temperature signal indicative of a temperature. With reference to FIG. 1, a pair of lower front displays are shown to be mounted on the front face of the housing at the periphery of the lower portion thereof. Ideally, the front displays are positioned on opposite sides of the speaker for displaying alphanumeric characters thereon. Also included is an upper front display mounted on the front face of the housing at the upper portion thereof also for displaying alphanumeric characters thereon. With reference now to FIG. 2, a rear display is shown to be centrally mounted on the rear face of the housing at the periphery of the lower portion thereof. Similar to the remaining displays, the rear display is adapted for displaying alphanumeric characters thereon. Positioned on the bottom face of the lower portion of the housing are four lights. These lights are in equally spaced relation. In use, the lights adapted for projecting light downwardly and outwardly upon the actuation thereof. Finally, a controller is positioned within the housing and connected to the speaker, sensors of the moisture/temperature sensor assembly, displays, and lights. When actuated by an actuation button, the controller is adapted to display a current time and a current temperature detected by the temperature sensor on the lower front displays and display the current temperature detected by the temperature sensor on the rear display. In addition, the controller actuates the lights in case of a power failure. Further, an alarm is emitted from the speaker upon the receipt of the activation signal. Finally, the controller serves to emit radio signals from the speaker. The upper front display is adapted to display a frequency of the radio signals on the upper front display. Ideally, the frequency of the radio signals may be selected by way of a plurality of horizontally aligned push buttons situated on the front face of the housing at the upper portion thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathing basin monitoring system apparatus and method which has many of the advantages of the water monitoring devices mentioned heretofore and many novel features that result in a new bathing basin monitoring system which is not anticipated, rendered obvious, suggested, or even implied by any of the prior art water monitoring devices, either alone or in any combination thereof.

It is another object of the present invention to provide a new bathing basin monitoring system which may be easily and efficiently manufactured and marketed.

It is a further object of the present invention to provide a new bathing basin monitoring system which is of a durable and reliable construction.

An even further object of the present invention is to provide a new bathing basin monitoring system which is susceptible of a low cost of manufacture with regard to both materials and labor, and which accordingly is then susceptible of low prices of sale to the consuming public, thereby making such bathing basin monitoring system economically available to the buying public.

Still yet another object of the present invention is to provide a new bathing basin monitoring system which provides in the apparatuses and methods of the prior art some of the advantages thereof, while simultaneously overcoming some of the disadvantages normally associated therewith.

Still another object of the present invention is to provide a new bathing basin monitoring system for indicating a temperature and the presence of a maximum water level within a bathing basin along with additional functions.

Even still another object of the present invention is to provide a new bathing basin monitoring system that includes a housing with a couple adapted for securing to a bathing basin. A speaker is mounted on the housing for emitting audio signals. Also included is a moisture/temperature sensor assembly having a moisture sensor positioned at a desired water line for generating an activation signal upon the detection of water and a temperature sensor for generating a temperature signal indicative of a temperature. At least one display is mounted on the housing for depicting numeric characters. A controller is positioned within the housing and connected to the speaker and sensors of the moisture/temperature sensor assembly. The controller serves to display a current temperature detected by the temperature sensor on the display and emit an alarm from the speaker upon the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
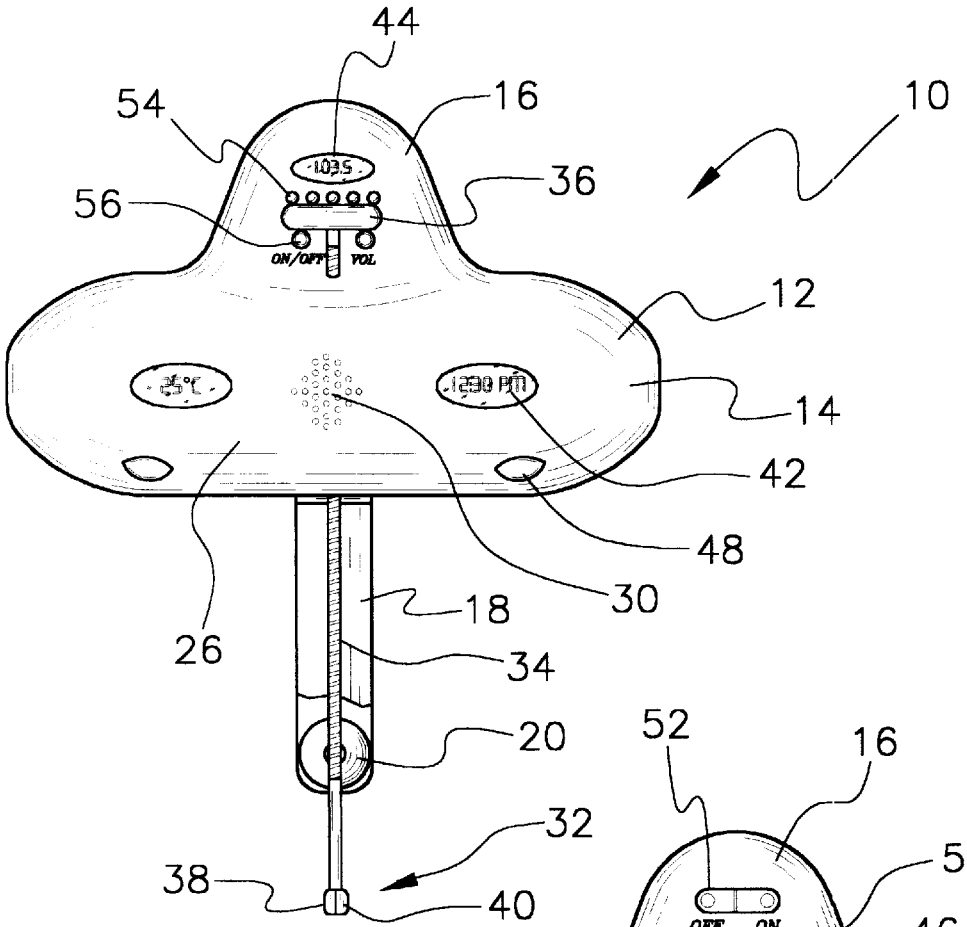
FIG. 1 is a front view of a new bathing basin monitoring system according to the present invention.

With reference now to the drawings, and in particular to FIGS. 1 through 4 thereof, a new bathing basin monitoring system embodying the principles and concepts of the present invention and generally designated by the reference numeral 10 will be described.

The present invention, designated as numeral 10, includes a water resistant housing 12 having a lower portion 14 with a circular horizontal cross-section and an elliptical vertical cross-section. The housing further has an upper portion 16 centrally mounted on a top face of the lower portion. Such upper portion has a circular horizontal cross-section with a tapering diameter from bottom to top.

Figure 3:
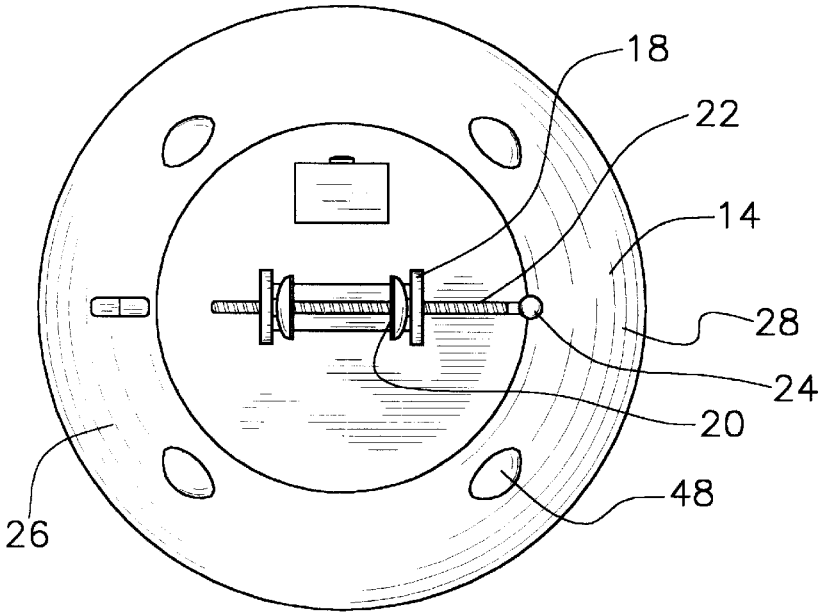
FIG. 3 is a bottom view of the present invention.
Figure 4:
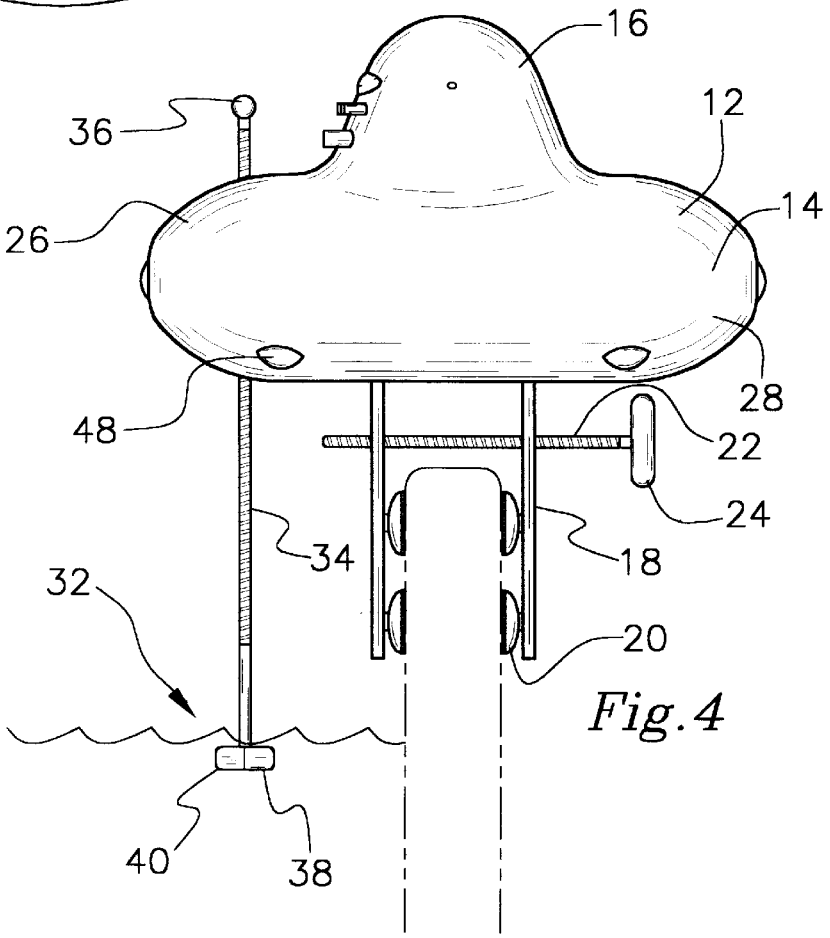
FIG. 4 is a side view of the present invention shown during use.

As shown in the Figures, the housing further includes a pair of rigid planar rectangular strips 18 each having a top end mounted on a bottom face of the lower portion of the housing. These strips extend downwardly from the housing in parallel relationship to define a slot. Ideally, the strips have a length about equal to a height of the housing. The slot between the strips is adapted for releasably receiving an upper peripheral edge of a bathing basin wall. A pair of vertically spaced suction cups 20 are mounted on inner surfaces of the strips which are adapted to engage the bathing basin wall. As best shown in FIGS. 3 & 4, a tightening threaded rod 22 is threadedly engaged within a pair of threaded apertures formed in the strips above the suction cups. A cylindrical handle 24 has a central extent mounted to the threaded rod for selectively rotation the same. By this structure, the strips may be securely clamped about the bathing basin wall.

It should be noted that the housing has a front face 26 on a side opposite the handle of the tightening rod and a rear face 28 opposite the front face. Mounted on the front face of the housing is a speaker 30 which is positioned at a periphery of the lower portion thereof for emitting audio signals.

Also included is a moisture/temperature sensor assembly 32 including a threaded rod 34 threadedly engaged within a vertically oriented threaded bore formed in the lower portion of the housing at the front face thereof. Similar to the clamping threaded rod, the present threaded rod is equipped with a cylindrical handle 36 having a central extent mounted to a top end of the threaded rod of the moisture/temperature sensor assembly. A moisture sensor 38 is positioned on a bottom end of the threaded rod of the moisture/temperature sensor assembly for generating an activation signal upon the detection of water. Associated therewith is a temperature sensor 40 mounted on the bottom end of the threaded rod of the moisture/temperature sensor assembly for generating a temperature signal indicative of a temperature.

With reference to FIG. 1, a pair of lower front displays 42 are shown to be mounted on the front face of the housing at the periphery of the lower portion thereof. Ideally, the lower front displays are positioned on opposite sides of the speaker for displaying alphanumeric characters thereon. Also included is an upper front display 44 mounted on the front face of the housing at the upper portion thereof also for displaying alphanumeric characters thereon.

Figure 2:
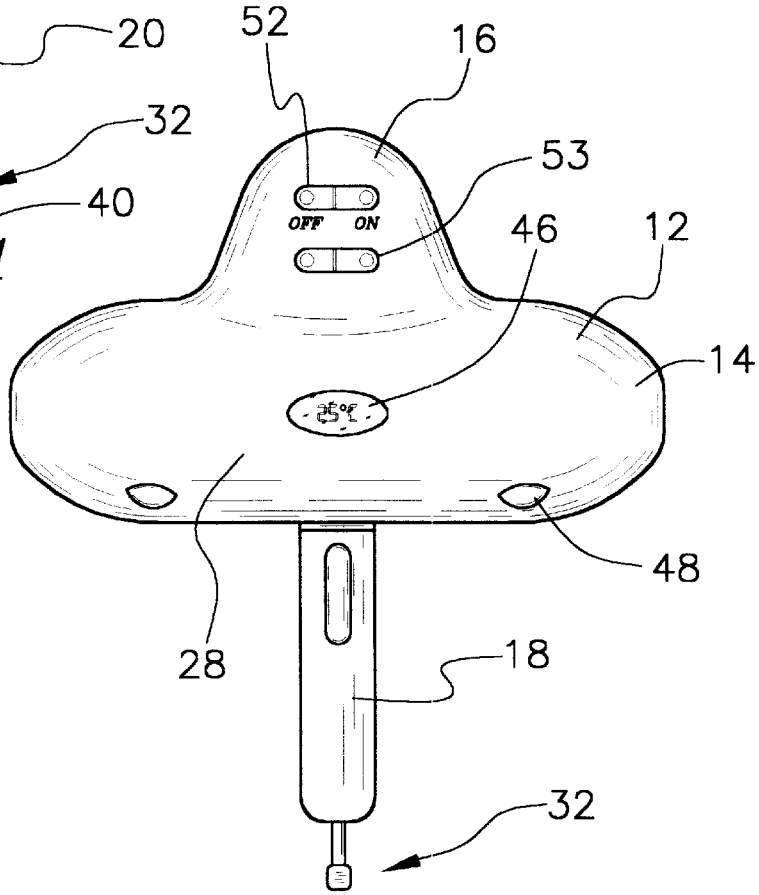
FIG. 2 is a rear view of the present invention.

With reference now to FIG. 2, a rear display 46 is shown to be centrally mounted on the rear face of the housing at the periphery of the lower portion thereof. Similar to the foregoing displays, the rear display is adapted for displaying alphanumeric characters thereon. Ideally, each of the displays has an oval configuration.

Positioned on the bottom face of the lower portion of the housing are four lights 48, or mood lights. These lights are in equally spaced relation. In use, the lights adapted for projecting light downwardly and outwardly upon the actuation thereof. In the preferred embodiment, dome shaped covers protrude from the housing for covering a source of each light.

Finally, a controller is positioned within the housing and connected to the speaker, sensors of the moisture/temperature sensor assembly, displays, lights, and an internal battery. Connection with the sensors may be accomplished by any means including a wire situated within a hollow interior of the associated threaded rod or connected thereto externally. When actuated by a toggle type actuation button 52, the controller is adapted to continuously display a current time and a current temperature detected by the temperature sensor on the lower front displays and continuously display the current temperature detected by the temperature sensor on the rear display. In addition, the controller actuates the lights in case of a power failure. As an option, actuation of the lights may be effected by a separate toggle type actuation button 53. Further, an alarm is emitted from the speaker upon the receipt of the activation signal, thereby indicating that the basin should no longer be filled with water. Finally, the controller serves to emit audible radio signals from the speaker by way of a digital radio unit positioned within the housing. The upper front display is adapted to display a frequency on which the radio signals are received on the upper front display. Ideally, the frequency of the radio signals may be selected by way of a plurality of horizontally aligned push buttons 54 situated on the front face of the housing at the upper portion thereof. Further options include a volume dial 56 and/or other controls for governing other types of parameters per the desires of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathing basin monitoring system comprising:

a housing with a couple adapted for securing to a bathing basin, the housing includes at least one light mounted on the housing for project light downwardly and outwardly upon the actuation thereof;

a speaker mounted on the housing for emitting audio signals;

a moisture/temperature sensor assembly including a moisture sensor positioned at a desired water line for generating an activation signal upon the detection of water and a temperature sensor for generating a temperature signal indicative of a temperature;

at least one display mounted on the housing for displaying numeric characters;

a controller positioned within the housing and connected to the speaker and the sensors of the moisture/temperature sensor assembly, the controller, upon the actuation thereof, adapted to depict a current temperature detected by the temperature sensor on the display and emit an alarm from the speaker upon the receipt of the activation signal.

2. A bathing basin monitoring system as set forth in claim 1 wherein the display is positioned on a rear face of the housing facing away from the bathing basin.

3. A bathing basin monitoring system as set forth in claim 1 wherein the display is positioned on a front face of the housing facing the bathing basin.

4. A bathing basin monitoring system as set forth in claim 1 wherein the controller is adapted to display a current time.

5. A bathing basin monitoring system as set forth in claim 1 wherein the controller is adapted to emit radio signals from the speaker and display a frequency of the radio signals.

6. A bathing basin monitoring system as set forth in claim 1 wherein the couple includes a pair of suction cups.

7. A bathing basin monitoring system as set forth in claim 1 wherein the couple includes a clamp with a threaded rod for clamping the same.

8. A bathing basin monitoring system as set forth in claim 1 wherein the moisture/temperature sensor assembly is mounted on a vertically adjusted rod.

9. A bathtub monitoring system comprising, in combination:

a housing including a lower portion with a circular horizontal cross-section and an elliptical vertical cross-section and an upper portion centrally mounted on a top face of the lower portion and having a circular horizontal cross-section with a tapering diameter from bottom to top, the housing further including a pair of rigid planar rectangular strips each having a top end mounted on a bottom face of the lower portion of the housing and extending downwardly therefrom in parallel relationship to define a slot adapted for releasably receiving an upper peripheral edge of a bathing basin wall, a pair of vertically spaced suction cups mounted on inner surfaces of the strips which are adapted to engage the bathing basin wall, and a tightening threaded rod threadedly engaged within a pair of threaded apertures formed in the strips above the suction cups with a cylindrical handle having a central extent mounted to the threaded rod for selectively rotation the same, thereby clamping the strips about the bathing basin wall, wherein the housing has a front face on a side opposite the handle of the tightening rod and a rear face opposite the front face;

a speaker mounted on the front face of the housing at a periphery of the lower portion thereof for emitting audio signals;

a moisture/temperature sensor assembly including a threaded rod threadedly engaged within a vertically oriented threaded bore formed in the lower portion of the housing at the front face thereof with a cylindrical handle having a central extent mounted to a top end of the threaded rod of the moisture/temperature sensor assembly and a moisture sensor mounted on a bottom end of the threaded rod of the moisture/temperature sensor assembly for generating an activation signal upon the detection of water, wherein a temperature sensor is mounted on the bottom end of the threaded rod of the moisture/temperature sensor assembly for generating a temperature signal indicative of a temperature;

a pair of lower front displays mounted on the front face of the housing at the periphery of the lower portion thereof on opposite sides of the speaker for displaying alphanumeric characters thereon;

an upper front display mounted on the front face of the housing at the upper portion thereof for displaying alphanumeric characters thereon;

a rear display centrally mounted on the rear face of the housing at the periphery of the lower portion thereof for displaying alphanumeric characters thereon;

four lights mounted on the bottom face of the lower portion of the housing in equally spaced relation for projecting light downwardly and outwardly upon the actuation thereof;

a controller positioned within the housing and connected to the speaker, sensors of the moisture/temperature sensor assembly, displays, and lights, the controller, upon the actuation thereof, adapted to display a current time and a current temperature detected by the temperature sensor on the lower front displays, display the current temperature detected by the temperature sensor on the rear display, actuate the lights, emit an alarm from the speaker upon the receipt of the activation signal, and emit radio signals from the speaker and display a frequency of the radio signals on the upper front display, wherein the frequency of the radio signals may be selected by way of a plurality of horizontally aligned push buttons situated on the front face of the housing at the upper portion thereof.

* * * * *